US007880702B2

(12) United States Patent
Shibahara

(10) Patent No.: US 7,880,702 B2
(45) Date of Patent: Feb. 1, 2011

(54) PICTURE DISPLAY APPARATUS

(75) Inventor: Hiroaki Shibahara, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 801 days.

(21) Appl. No.: 11/755,365

(22) Filed: May 30, 2007

(65) Prior Publication Data

US 2007/0279356 A1 Dec. 6, 2007

(30) Foreign Application Priority Data

May 30, 2006 (JP) ..... 2006-150123

(51) Int. Cl.
*G09G 3/36* (2006.01)

(52) U.S. Cl. ..... 345/87; 345/102

(58) Field of Classification Search ..... 345/63, 345/68, 77, 87, 102, 156, 204, 207, 82, 212, 345/660; 348/565; 386/46, 94; 725/31; 349/61, 68

See application file for complete search history.

(56) References Cited

U.S. PATENT DOCUMENTS

| | | | | |
|---|---|---|---|---|
| 5,078,476 | A | 1/1992 | Shin | |
| 5,808,591 | A * | 9/1998 | Mantani | 345/82 |
| 5,926,602 | A * | 7/1999 | Okura | 386/13 |
| 5,973,656 | A * | 10/1999 | Yokoi et al. | 345/82 |
| 6,052,119 | A * | 4/2000 | Chiang | 345/212 |
| 6,067,070 | A * | 5/2000 | Suzuki et al. | 345/660 |
| 6,111,622 | A * | 8/2000 | Abileah | 349/61 |
| 7,595,784 | B2 * | 9/2009 | Yamamoto et al. | 345/102 |
| 2002/0057241 | A1 * | 5/2002 | Oda et al. | 345/87 |
| 2003/0086695 | A1 * | 5/2003 | Okamoto et al. | 386/94 |
| 2003/0154377 | A1 * | 8/2003 | Hirai et al. | 713/176 |
| 2004/0104883 | A1 | 6/2004 | Drader | |
| 2005/0078081 | A1 * | 4/2005 | Oda et al. | 345/102 |
| 2005/0113157 | A1 * | 5/2005 | Jaakola | 455/575.6 |

(Continued)

FOREIGN PATENT DOCUMENTS

EP 1 531 453 A2 5/2005

(Continued)

OTHER PUBLICATIONS

Masahito Kondo; Descrambler for TV signal; Pub.No. JP 08237634 A; Appl. No. JP07058005; Appl Date Feb. 22, 1995.*

(Continued)

*Primary Examiner*—Prabodh M Dharia
(74) *Attorney, Agent, or Firm*—Crowell & Moring LLP

(57) ABSTRACT

A picture display apparatus, which displays a picture on a display section based on a picture signal, includes an input determining section determining whether the picture signal is input, a display determining section determining, based on whether sight/hearing restricting information is added to the picture signal, whether the picture based on the picture signal can be displayed, when the input determining section determines that the picture signal is input, a scramble determining section determining whether the picture signal is scrambled, when the input determining section determines that the picture signal is input, and a display control section lowering a brightness of a backlight of the display section and displaying a predetermined display with hollow characters indicating that the picture cannot be displayed when the picture signal is not input, when the picture based on the picture signal cannot be displayed, and when the picture signal is scrambled.

8 Claims, 4 Drawing Sheets

U.S. PATENT DOCUMENTS

| | | | | |
|---|---|---|---|---|
| 2005/0160468 | A1* | 7/2005 | Rodriguez et al. | 725/109 |
| 2005/0231457 | A1* | 10/2005 | Yamamoto et al. | 345/102 |
| 2006/0029363 | A1* | 2/2006 | Iggulden et al. | 386/46 |
| 2006/0055657 | A1* | 3/2006 | Koyama et al. | 345/102 |
| 2006/0155649 | A1* | 7/2006 | Ogino et al. | 705/51 |
| 2007/0024772 | A1* | 2/2007 | Childers et al. | 349/68 |
| 2007/0214475 | A1* | 9/2007 | Lee et al. | 725/31 |
| 2007/0296689 | A1* | 12/2007 | Kimura et al. | 345/102 |
| 2009/0256974 | A1* | 10/2009 | Mukai | 348/751 |

FOREIGN PATENT DOCUMENTS

| | | | |
|---|---|---|---|
| JP | 11-85091 | A | 3/1999 |
| JP | 2003-271106 | A | 9/2003 |

OTHER PUBLICATIONS

"Purchasing An Energy Star Computer Star Computer" Document United States Environmental Protection Agency, United States Environmental Protection Agency, US, Jul. 1, 1994, No. 430-K-94-006, XP002398754, pp. 1-4.

European Search Report dated Jul. 8, 2008 Eight (8) pages.

European Office Action dated Jun. 4, 2009 (Five (5) pages).

* cited by examiner

PICTURE DISPLAY APPARATUS

BACKGROUND OF THE INVENTION

1. Field of the Invention

The present invention relates to a picture display apparatus.

2. Description of the Related Art

There is a conventionally known picture display apparatus having a display section such as a liquid crystal display in which a picture based on an input picture signal is displayed on the display screen, and when a picture signal of a specific static image such as a color-bar is being input, the brightness of backlight of the display section is lowered to reduce power consumption and increase life spans of parts (Japanese Patent Application Laid-open No. 2003-271106, for example).

There is also known a picture display apparatus in which when it is not operated, backlight of the display section is put out (Japanese Patent Application Laid-open No. 11-085091, for example).

In the picture display apparatus, when a picture signal is not input or when only picture cannot be displayed due to sight/hearing restriction, an operation state of the picture display apparatus such as "No Signal" or "Restricted" is shown on the display section.

In the picture display apparatus according to the Japanese Patent Application Laid-open No. 2003-271106, the backlight of the display screen remains on as in the usual operation state also when the above-described operation state is displayed. Thus, power consumption cannot sufficiently be reduced and the life spans of parts cannot sufficiently be increased. In the picture display apparatus according to the Japanese Patent Application Laid-open No. 11-085091, since the backlight is put out, the operation state of the picture display apparatus cannot be displayed.

SUMMARY OF THE INVENTION

It is an object of the present invention to provide a picture display apparatus in which a user can recognize an operation state that a picture based on a picture signal is not displayed, power consumption can be reduced and life spans of parts can be increased.

According to a first aspect of the present invention, there is provided a picture display apparatus to display a picture on a display section based on a picture signal, comprising, an input determining section to determine whether the picture signal is input, a display determining section to determine, based on whether sight/hearing restricting information is added to the picture signal, whether the picture based on the picture signal can be displayed, when the input determining section determines that the picture signal is input, a scramble determining section to determine whether the picture signal is scrambled, when the input determining section determines that the picture signal is input, and a display control section to lower a brightness of a backlight of the display section and to display a predetermined display with hollow characters indicating that the picture cannot be displayed when the input determining section determines that the picture signal is not input, when the display determining section determines that the picture based on the picture signal cannot be displayed, and when the scramble determining section determines that the picture signal is scrambled.

According to a second aspect of the present invention, there is provided a picture display apparatus to display a picture based on a picture signal on a display section, comprising, an input determining section to determine whether the picture signal is input, a display determining section to determine, based on whether sight/hearing restricting information is added to the picture signal, whether the picture based on the picture signal can be displayed, when the input determining section determines that the picture signal is input, and a display control section to lower a brightness of a backlight of the display section and to display a predetermined display indicating that the picture cannot be displayed when the display determining section determines that the picture based on the picture signal cannot be displayed.

According to a third aspect of the present invention there is provided a picture display apparatus to display a picture based on a picture signal on a display section, comprising, an input determining section to determine whether the picture signal is input, a scramble determining section to determine whether the picture signal is scrambled when the input determining section determines that the picture signal is input, and a display control section to lower a brightness of a backlight of the display section and to display a predetermined display indicating that the picture cannot be displayed when the scramble determining section determines that the picture signal is scrambled.

BRIEF DESCRIPTION OF THE DRAWINGS

The above and further objects features and advantages of the present invention will become more apparent from the following detailed description taken in conjunction with the accompanying drawings, wherein.

DESCRIPTION OF THE PREFERRED EMBODIMENTS

Picture display apparatuses according to preferred embodiments of the present invention will be explained in detail with reference to the drawings. Although a liquid crystal display apparatus 100 will be explained as an example of the picture display apparatus in the embodiments, the present invention is not limited to this.

Figure 1:
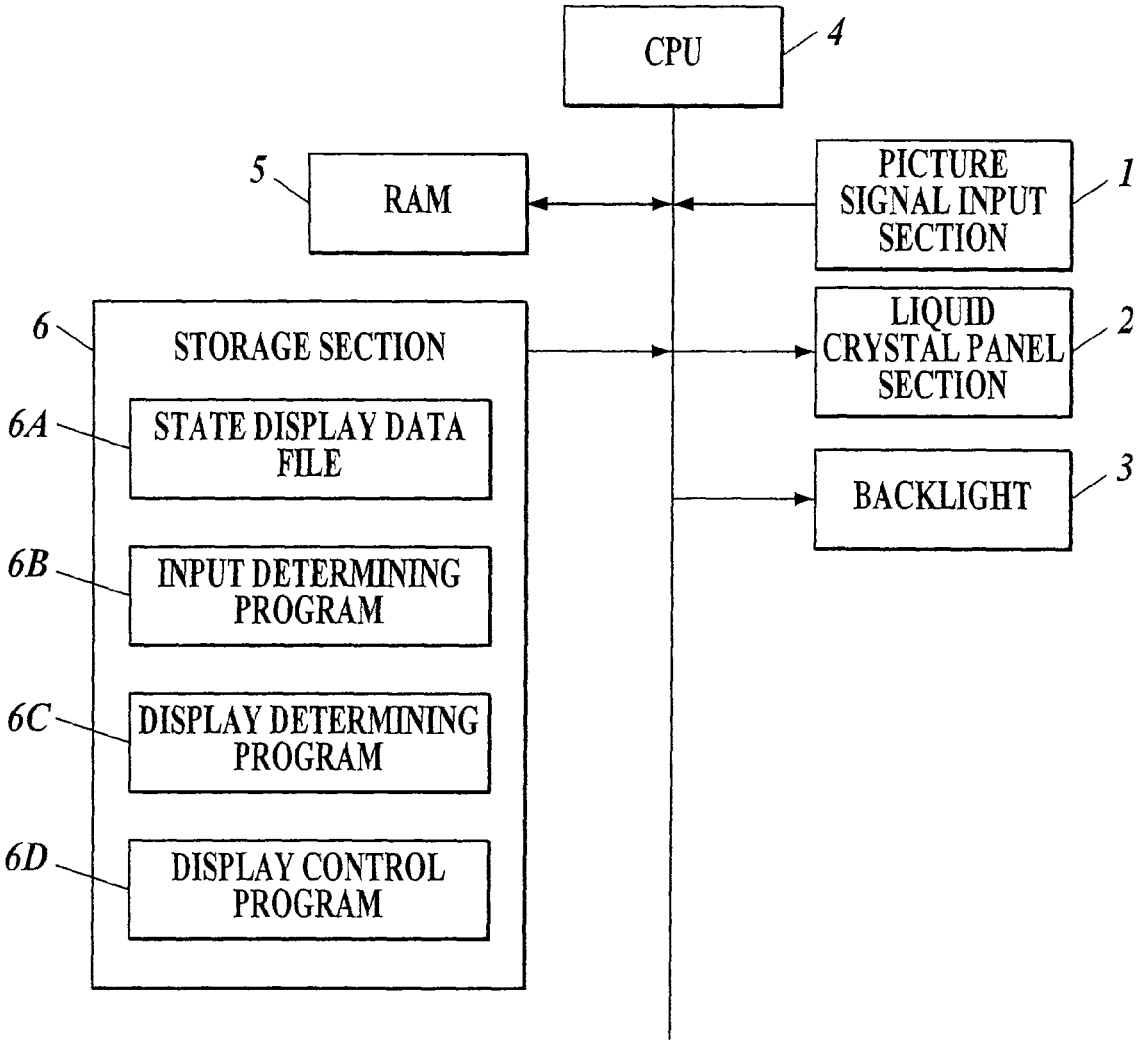
FIG. 1 is a block diagram showing an outline structure of a picture display apparatus according to preferred embodiments of the present invention.

A structure of the liquid crystal display apparatus 100 according to the preferred embodiments of the present invention will be explained with reference to FIG. 1. As shown in FIG. 1, the liquid crystal display apparatus 100 of the embodiment includes a picture signal input section 1, a liquid crystal panel section 2 as a display section, a backlight 3, a CPU (Central Processing Unit) 4, a RAM (Random Access Memory) 5 and a storage section 6.

The picture signal input section 1, for example, is connected to external equipment such as a digital television receiver (not shown) and a DVD reproducing unit (not shown), and the picture signal input section 1 outputs, to the CPU 4, a picture signal which is input from the external equipment.

The liquid crystal panel section 2, for example, is a liquid crystal display. The liquid crystal panel section 2 displays a picture based on a picture signal which is input from the picture signal input section 1. The liquid crystal panel section 2 has a liquid crystal panel (not shown) and a front panel (not shown). A liquid crystal is sandwiched between two opposed clear insulative base materials (e.g., glass plates; not shown). Voltage is applied to electrodes (not shown) mounted on the clear insulative base materials, light polarized by the liquid crystal passes through a polarizing plate (not shown), and the liquid crystal panel controls this light such that the light passes or does not pass through the liquid crystal panel. The front panel has substantially the same shape as that of the liquid crystal panel, and has an area slightly wider than that of the liquid crystal panel. The front panel is provided in front of the liquid crystal panel.

The backlight 3 is disposed behind the liquid crystal panel. The backlight 3 applies light toward the front panel through the liquid crystal and the polarizing plate. The liquid crystal panel switches between transmittance and non-transmittance based on a picture signal so that a picture based on the picture signal is displayed on the liquid crystal panel section 2.

The backlight 3 includes, for example, a plurality of fluorescent tubes (not shown), and the backlight 3 is disposed behind the liquid crystal panel section 2 (liquid crystal panel).

The CPU 4, for example, reads out a processing program stored in the storage section 6, develops the processing program at the RAM 5 and executes the program, thereby controlling the entire liquid crystal display apparatus 100.

The RAM 5 has a program storing region and a data storing region. The RAM 5 develops the processing program executed by the CPU 4 in the program storing region, and stores, in the data storing region, input data and a result of the processing and the like generated when the processing program is executed.

The storage section 6 has, for example, a storing medium (not shown) in which a program, data and the like are previously stored. The storing medium comprises, for example, a semiconductor memory. The storage section 6 stores various data sets and various processing programs which are required by the CPU 4 for realizing functions of controlling the entire liquid crystal display apparatus 100, data processed by execution of these programs, and so forth. More specifically, the storage section 6 stores a state display data file 6A, an input determining program 6B, a display determining program 6C, a display control program 6D, and so on as shown in FIG. 1.

The state display data file 6A stores, for example, data concerning predetermined display indicating that a picture cannot be displayed on the liquid crystal panel section 2 when a picture signal is not input or when the sight/hearing restricting information is added to the picture signal. The predetermined display is displayed on the liquid crystal panel section 2 when the CPU 4 executes the display control program 6D. For example, the predetermined display includes "No Signal" indicating that a picture signal is not input, and "Restricted" indicating that a picture cannot be displayed due to sight/hearing restricting.

The input determining program 6B makes for example, the CPU 4 realize a function of determining whether a picture signal is input from the picture signal input section 1. More specifically, the input determining program 6B makes the CPU 4 detect a level of a signal which is input through an input terminal of the picture signal input section 1, thereby determining whether a picture signal is input from the picture signal input section 1. If the CPU 4 executes the input determining program 6B, the CPU 4 functions as an input determining section.

The display determining program 6C makes for example, the CPU 4 execute the input determining program 6B, and when it is determined that a picture signal is input from the picture signal input section 1, the CPU 4 determines, based on whether sight/hearing restricting information is added to the picture signal, whether a picture based on the picture signal can be displayed. The display determining program 6C makes, for example, the CPU 4 execute the input determining program 6B, and when the CPU 4 determines that a picture signal is input from the picture signal input section 1, the display determining program 6C makes the CPU 4 determine whether the picture signal is scrambled. If the CPU 4 executes the display determining program 6C, the CPU 4 functions as a display determining section and a scramble determining section.

The display control program 6D makes for example, the CPU 4 lower the brightness of the backlight 3 and display the predetermined display, for example, indicating that a picture cannot be displayed by means of hollow characters when it is determined that a picture signal is not input from the picture signal input section 1 by executing the input determining program 6B, when it is determined that the sight/hearing restricting information is added to the picture signal, and when it is determined that the picture signal is scrambled by executing the display determining program 6C. More specifically, the CPU 4 executes the display control program 6D, to extract data of the predetermined display from the state display data file 6A, and to display the predetermined display, based on predetermined display data, on the liquid crystal panel section 2. If the CPU 4 executes the display control program 6D, the CPU 4 functions as a display control section.

Figure 2:
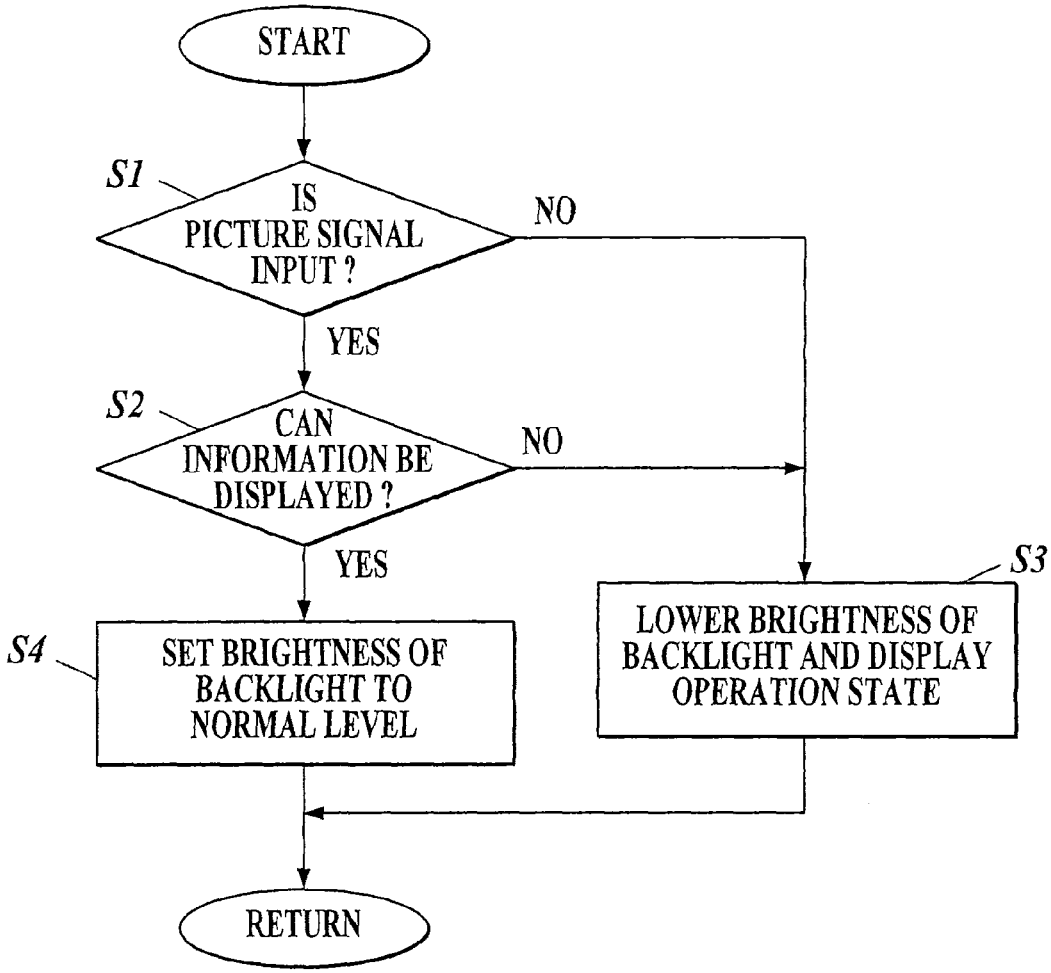
FIG. 2 is a flowchart showing a picture displaying operation of the picture display apparatus of the preferred embodiments of the present invention.

Next, a picture display operation of the liquid crystal display apparatus 100 according to the preferred embodiments of the present invention will be explained with reference to a flowchart in FIG. 2.

First, the CPU 4 executes the input determining program 6B, and determines whether a picture signal is input from the picture signal input section 1 (step S1).

If the CPU 4 determines that the picture signal is not input in step S1 (step S1; No), the procedure is advanced to step S3.

If the CPU 4 determines that the picture signal is input in step S1, (step S1; Yes), the CPU 4 executes the display determining program 6C, to determine whether sight/hearing restricting information is added to the input picture signal and whether the input picture signal is scrambled, thereby determining whether a picture based on the picture signal can be displayed on the liquid crystal panel section 2 (step S2).

In step S2, when the CPU 4 determines that a picture based on the picture signal cannot be displayed (step S2; No), the CPU 4 executes the display control program 6D, to lower the brightness of the backlight 3, and to display the predetermined display indicating the operation state of the liquid crystal display apparatus 100 on the liquid crystal panel section 2 (step S3).

When the CPU 4 determines that the picture based on the picture signal can be displayed in step S2 (step S2; Yes), the CPU 4 does not lower the brightness of the backlight 3, and display the picture based on the picture signal on the liquid crystal panel section 2 (step S4).

Figure 3A:
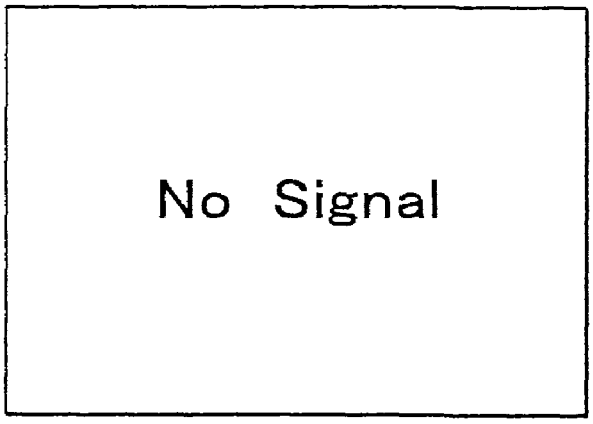
FIGS. 3A and 3B are explanatory diagrams of a display on a liquid crystal panel section of the picture display apparatus of the preferred embodiments of the present invention.

Next, one example of a display by the liquid crystal panel section 2 in step S3 will be explained with reference to FIGS. 3A, 3B, 4A and 4B. FIGS. 3A and 4A show screens displaying operation states in the conventional liquid crystal display apparatus. Conventionally, when the operation state of the liquid crystal display apparatus is displayed, as shown in FIGS. 3A and 4A, the brightness of the backlight is the same as that of the normal case, and the entire screen of the liquid crystal panel section is bright, and the predetermined display indicating the operation state, e.g., "No Signal" is shown with black characters for example.

Figure 3B:
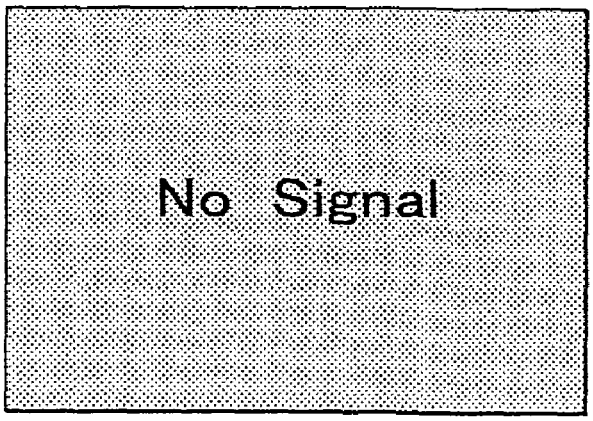
Figure 4A:
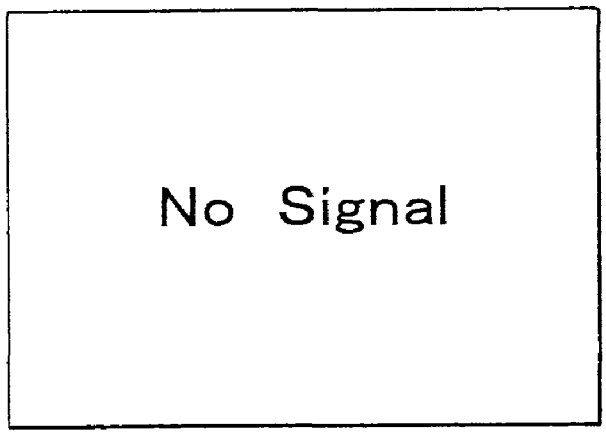
FIGS. 4A and 4B are explanatory diagrams of a display on a liquid crystal panel section of the picture display apparatus of the preferred embodiments of the present invention.

In the case of the liquid crystal display apparatus 100 according to the preferred embodiments of the present invention, when the operation state is displayed, the brightness of the backlight 3 is lowered and the entire screen of the liquid crystal panel section 2 is darker than the normal case as shown in FIG. 3B, and the predetermined display indicating the operation state of the liquid crystal display apparatus 100, e.g., "No Signal" is shown with black characters for example.

Figure 4B:
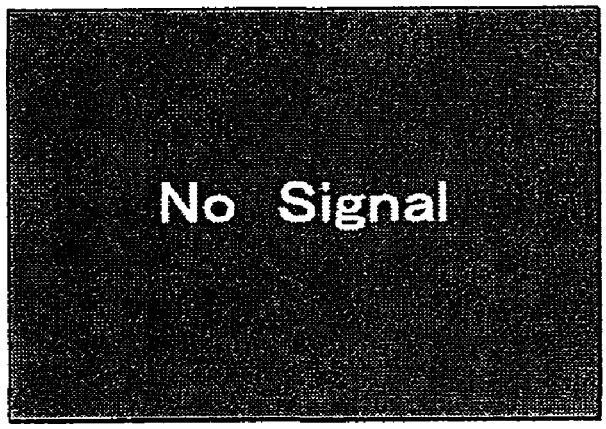

When the operation state is displayed in the liquid crystal display apparatus 100 according to the preferred embodiments of the present invention, as shown in FIG. 4B, the brightness of the backlight 3 is completely cut, the entire screen of the liquid crystal panel section 2 is pitch dark, and the predetermined display showing the operation state of the 100, e.g., "No Signal" is shown with hollow characters, and the predetermined display can be seen by reflection of natural light.

According to the liquid crystal display apparatus 100 of the preferred embodiments of the present invention explained above, if the CPU 4 executes the input determining program 6B, it is determined whether a picture signal is input, and if the CPU 4 executes the display determining program 6C to execute the input determining program 6B and determines that the picture signal is input, it is determined, based on whether sight/hearing restricting information is added to the picture signal, whether a picture based on the picture signal can be displayed, and it is determined whether the picture signal is scrambled. If the CPU 4 executes the display control program 6D and determines that the picture signal is not input, that the sight/hearing restricting information is added to the picture signal or that the picture signal is scrambled, the brightness of the backlight 3 of the liquid crystal panel section 2 is lowered. Therefore, the power consumption can be reduced and the life spans of parts can be increased. Further, when the CPU 4 executes the display control program 6D and determines that the picture signal is not input, that the sight/hearing restricting information is added to the picture signal, or that the picture signal is scrambled, the predetermined display indicating a picture cannot be displayed is displayed on the liquid crystal panel section 2. Therefore, a user can recognize the operation state that a picture based on the picture signal is not displayed.

Since the predetermined display is displayed on the liquid crystal panel section 2 with the hollow characters, even when the brightness of the backlight 3 is lowered and the screen of the liquid crystal panel section 2 becomes dark, the predetermined display can easily be seen.

The picture display apparatus of the present invention is not limited to the liquid crystal display apparatus 100 only if a picture based on the picture signal can be displayed using the backlight 3.

When the picture display apparatus of the invention lowers the brightness of the backlight 3 and shows the operation state, the invention is not limited to the embodiment only if a picture signal cannot be output even when the picture signal is input. The invention can be applied to a case when the picture signal is being scanned.

According to one aspect of the preferred embodiments of the present invention, there is provided a picture display apparatus to display a picture on a display section based on a picture signal, comprising, an input determining section to determine whether the picture signal is input, a display determining section to determine, based on whether sight/hearing restricting information is added to the picture signal, whether the picture based on the picture signal can be displayed, when the input determining section determines that the picture signal is input, a scramble determining section to determine whether the picture signal is scrambled, when the input determining section determines that the picture signal is input, and a display control section to lower a brightness of a backlight of the display section and to display a predetermined display with hollow characters indicating that the picture cannot be displayed when the input determining section determines that the picture signal is not input, when the display determining section determines that the picture based on the picture signal cannot be displayed, and when the scramble determining section determines that the picture signal is scrambled.

In the above-mentioned picture display apparatus, the input determining section determines whether the picture signal is input, the display determining section determines, based on whether sight/hearing restricting information is added to the picture signal, whether the picture based on the picture signal can be displayed, when the input determining section determines that the picture signal is input, the scramble determining section determines whether the picture signal is scrambled, when the input determining section determines that the picture signal is input. The display control section lowers the brightness of the backlight of the display section and displays predetermined display with hollow characters indicating that the picture cannot be displayed when the input determining section determines that the picture signal is not input, when the display determining section determines that a picture based on the picture signal cannot be displayed, and when the scramble determining section determines that the picture signal is scrambled. Thus, the power consumption can be reduced and life spans of parts can be increased. When the picture cannot be displayed, the predetermined display indicating that the picture cannot be displayed is displayed on the display section. Thus, a user can recognize the operation state that the picture based on the picture signal cannot be displayed.

Further, since the display control section displays the predetermined display by means of hollow characters on the display section, even if the brightness of the backlight is lowered and the screen of the display section becomes dark, the predetermined display can be seen easily.

According to another aspect of the preferred embodiments of the present invention, there is provided a picture display apparatus to display a picture based on a picture signal on a display section, comprising, an input determining section to determine whether the picture signal is input, a display determining section to determine, based on whether sight/hearing restricting information is added to the picture signal, whether the picture based on the picture signal can be displayed, when the input determining section determines that the picture signal is input, and a display control section to lower a brightness of a backlight of the display section and to display a predetermined display indicating that the picture cannot be displayed when the display determining section determines that the picture based on the picture signal cannot be displayed.

In the above-mentioned picture display apparatus, the input determining section determines whether the picture signal is input, and when the input determining section determines that the picture signal is input, the display determining section determines, based on whether the sight/hearing restricting information is added to the picture signal, whether a picture based on the picture signal can be displayed, when the display determining section determines that the picture based on the picture signal cannot be displayed, and the display control section lowers the brightness of the backlight in the display section. Therefore, the power consumption can be reduced and life spans of parts can be increased. Further, when the display determining section determines that the picture based on the picture signal cannot be displayed, the display control section displays, on the display section, the predetermined display indicating that the picture cannot be displayed. Thus, a user can recognize the operation state that the picture based on the picture signal is not displayed.

According to still another aspect of the preferred embodiments of the present invention, there is provided a picture display apparatus to display a picture based on a picture signal on a display section, comprising, an input determining section to determine whether the picture signal is input, a scramble determining section to determine whether the picture signal is scrambled when the input determining section determines that the picture signal is input, and a display control section to lower a brightness of a backlight of the display section and to display a predetermined display indicating that the picture cannot be displayed when the scramble determining section determines that the picture signal is scrambled.

The input determining section determines whether the picture signal is input, and when the input determining section determines that the picture signal is input, the scramble determining section determines whether the picture signal is scrambled, and when the scramble determining section determines that the picture signal is scrambled, the display control section lowers the brightness of the backlight of the display section. Therefore, the power consumption can be reduced and life spans of parts can be increased. When the scramble determining section determines that the picture signal is scrambled, the display control section displays, on the display section, the predetermined display indicating a picture cannot be displayed. Thus, a user can recognize the operation state that the picture based on the picture signal is not displayed.

Preferably, the display control section displays the predetermined display on the display section by means of hollow characters.

Since the display control section displays, on the display section, the predetermined display by means of hollow characters, even if the brightness of the backlight is lowered and the screen of the display section becomes dark, and the predetermined display can be seen easily.

The entire disclosure of Japanese Patent Application No. 2006-150123 filed on May 30, 2006 including specification, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A picture display apparatus to display a picture on a display section based on a picture signal, comprising:

an input determining section to determine whether the picture signal is input;

a display determining section to determine, based on whether sight/hearing restricting information is added to the picture signal, whether the picture based on the picture signal can be displayed, when the input determining section determines that the picture signal is input;

a scramble determining section to determine whether the picture signal is scrambled, when the input determining section determines that the picture signal is input; and a display control section to lower a brightness of a backlight of the display section and to display a predetermined display with hollow characters indicating that the picture cannot be displayed when the input determining section determines that the picture signal is not input, when the display determining section determines that the picture based on the picture signal cannot be displayed, and when the scramble determining section determines that the picture signal is scrambled.

2. A picture display apparatus to display a picture based on a picture signal on a display section, comprising:

an input determining section to determine whether the picture signal is input;

a display determining section to determine, based on whether sight/hearing restricting information is added to the picture signal, whether the picture based on the picture signal can be displayed, when the input determining section determines that the picture signal is input; and a display control section to lower a brightness of a backlight of the display section and to display a predetermined display indicating that the picture cannot be displayed when the display determining section determines that the picture based on the picture signal cannot be displayed.

3. A picture display apparatus to display a picture based on a picture signal on a display section, comprising:

an input determining section to determine whether the picture signal is input;

a scramble determining section to determine whether the picture signal is scrambled when the input determining section determines that the picture signal is input; and a display control section to lower a brightness of a backlight of the display section and to display a predetermined display indicating that the picture cannot be displayed when the scramble determining section determines that the picture signal is scrambled.

4. The picture display apparatus according to claim 2, wherein the display control section displays the predetermined display on the display section by means of hollow characters.

5. A picture display apparatus to display a picture on a display section based on a picture signal, comprising:

a display section;

a backlight disposed behind the display section;

a storage section to store data corresponding to a message indicating that the picture cannot be displayed;

an input determining section to determine whether the picture signal is input; and a display control section to completely cut a brightness of the backlight, wherein the display control section is further adapted for reading the data from the storage section and causing the display section to display the message based on the read data using reflection of natural light from the display section, while the brightness of the backlight is completely cut when the input determining section determines that the picture signal is not input.

6. The picture display apparatus according to claim 5, further comprising:

a display determining section to determine, based on whether sight/hearing restricting information is added to the picture signal, whether the picture based on the picture signal can be displayed, when the input determining section determines that the picture signal is input, wherein the display control section completely cuts the brightness of the backlight of the display section and displays the message indicating that the picture cannot be displayed when the display determining section determines that the picture based on the picture signal cannot be displayed.

7. The picture display apparatus according to claim 5, further comprising:

a scramble determining section to determine whether the picture signal is scrambled when the input determining section determines that the picture signal is input, wherein the display control section completely cuts the brightness of the backlight of the display section and displays the message indicating that the picture cannot be displayed when the scramble determining section determines that the picture signal is scrambled.

8. The picture display apparatus according to claim 5, wherein the display control section displays the message with white characters using the reflection of natural light.

* * * * *